US008907873B2

(12) United States Patent
Liu

(10) Patent No.: US 8,907,873 B2
(45) Date of Patent: Dec. 9, 2014

(54) ORGANIC LIGHT EMITTING DISPLAY PANEL AND METHOD FOR DRIVING THE SAME

(75) Inventor: Yawei Liu, Shenzhen (CN)

(73) Assignee: Shenzhen China Star Optoelectronics Technology Co., Ltd., Guangdong (CN)

( * ) Notice: Subject to any disclaimer, the term of this patent is extended or adjusted under 35 U.S.C. 154(b) by 89 days.

(21) Appl. No.: 13/639,385

(22) PCT Filed: Jul. 31, 2012

(86) PCT No.: PCT/CN2012/079409
§ 371 (c)(1),
(2), (4) Date: Oct. 4, 2012

(87) PCT Pub. No.: WO2013/185411
PCT Pub. Date: Dec. 19, 2013

(65) Prior Publication Data

US 2013/0335306 A1 Dec. 19, 2013

(30) Foreign Application Priority Data

Jun. 15, 2012 (CN) ..... 2012 1 0198985

(51) Int. Cl.
*G09G 3/28* (2013.01)
*G09G 3/32* (2006.01)

(52) U.S. Cl.
USPC ..... 345/76; 345/82

(58) Field of Classification Search
CPC ..... G09G 3/30; G09G 3/3208
USPC ..... 345/76, 82
See application file for complete search history.

(56) References Cited

U.S. PATENT DOCUMENTS

| | | | | |
|---|---|---|---|---|
| 7,675,061 | B2 * | 3/2010 | Joo et al. | 257/59 |
| 2005/0237281 | A1 * | 10/2005 | Tam | 345/76 |
| 2006/0227081 | A1 * | 10/2006 | Joo et al. | 345/76 |
| 2007/0001938 | A1 * | 1/2007 | Lee et al. | 345/76 |

* cited by examiner

*Primary Examiner* — Chanh Nguyen
*Assistant Examiner* — Yuzhen Shen

(57) ABSTRACT

The present invention provides an organic light-emitting display (OLED) panel and a method for driving the same. The OLED panel comprises pixel rows, data lines, scan lines and power lines, and each of the pixel rows includes pairs of first and second pixels, and the data lines cross the scan lines, and the power lines are arranged parallel to the pixel rows. When driving the first or second pixel, two of the scan lines are turned on at the same time, and the two turned-on scan lines are positioned at two opposite sides of the driven first or second pixel.

5 Claims, 3 Drawing Sheets

ORGANIC LIGHT EMITTING DISPLAY PANEL AND METHOD FOR DRIVING THE SAME

FIELD OF THE INVENTION

The present invention relates to a field of an organic light-emitting display (OLED) technology, and more particularly to an OLED panel and a method for driving the same.

BACKGROUND OF THE INVENTION

Recently, with the advance of science and technology, many types of display apparatus have been widely applied in flat panel displays (FPDs), such as liquid crystal displays (LCDs), electro luminescence (EL) displays or organic light-emitting diode (OLED) displays.

However, in a conventional OLED panel, two gate lines, a data line and a power line are required to define a boundary of one pixel, and the pixel needs two thin film transistors (TFTs) and a storage capacitor, thereby reducing an aperture ration of the pixel.

As a result, it is necessary to provide an OLED panel and a method for driving the same to solve the problems existing in conventional technologies such as above-mentioned.

SUMMARY OF THE INVENTION

The present invention provides an OLED panel and a method for driving the same to solve the problem of a decreased aperture ration.

A primary object of the present invention is to provide an OLED panel, and the OLED panel comprises: a substrate; a plurality of pixel rows arranged on the substrate, wherein each of the pixel rows includes pairs of first and second pixels adjacent to each other; a plurality of data lines arranged parallel to the pixel rows and positioned between the first and second pixels, respectively; a plurality of scan lines crossing the data lines; and a plurality of power lines arranged parallel to the pixel rows and positioned two opposite sides of each of the pixel rows, respectively, wherein, when driving one of the first pixels and the second pixels, two of the scan lines are turned on at the same time, and the turned-on scan lines are positioned at two opposite sides of the driven first or second pixel.

In one embodiment of the present invention, each of the first pixels includes a first switching transistor and a first driving transistor, and each of the second pixels includes a second switching transistor and a second driving transistor, and the first switching transistor is connected to the scan line, the first driving transistor and the second switching transistor, and the first driving transistor is connected to the first switching transistor, the power line and an OLED unit in each of the first pixels, and the second switching transistor is connected to the scan line, the data line and the second driving transistor, and the second driving transistor is connected to the second switching transistor, the power line and the OLED unit in each of the second pixels.

In one embodiment of the present invention, in one of the first pixels, a gate electrode of the first switching transistor is connected to one of the scan line, and a source electrode of the first switching transistor is connected to the second switching transistor of one adjacent second pixel, and a drain electrode of the first switching transistor is connected to the first driving transistor, and a gate of the first driving transistor is connected to the drain electrode of the first switching transistor, and a source electrode of the first driving transistor is connected to one adjacent power line, and a drain electrode of the first driving transistor is connected to the OLED unit of the first pixel.

In one embodiment of the present invention, in one of the second pixels, a gate electrode of the second switching transistor is connected to one of the scan lines, and a source electrode of the second switching transistor is connected to the data line, and a drain electrode of the second switching transistor is connected to the second driving transistor, and a gate of the second driving transistor is connected to the drain electrode of the second switching transistor, and a source electrode of the second driving transistor is connected to one adjacent power line, and a drain electrode of the second driving transistor is connected to the OLED unit in the second pixel.

In one embodiment of the present invention, data signals are provided to the first pixels and/or the second pixels through the data lines, and scan signals are provided to the first pixels and/or the second pixels through the scan lines, and each of the scan signals is twice as wide as each of the data signals, and turned-on durations of each adjacent two of the scan lines are partially overlapped.

A secondary object of the present invention is to provide a method for driving an OLED panel, wherein the OLED panel comprises a plurality of pixel rows, a plurality of data lines, a plurality of scan lines and a plurality of power lines, and each of the pixel rows includes pairs of first and second pixels adjacent to each other, and the data lines are arranged parallel to the pixel rows and positioned between the first and second pixels, respectively, and the scan lines cross the data lines, and the power lines are arranged parallel to the pixel rows and positioned two opposite sides of each of the pixel rows, respectively, and the method comprises the following steps: providing data signals to the first pixels and/or the second pixels through the data lines; providing a voltage to the first pixels and/or the second pixels through the power lines; and providing scan signals to the first pixels and the second pixels in sequence through the scan lines, wherein, when driving one of the first pixels and the second pixels, two of the scan lines are turned on at the same time, and the two turned-on scan lines are positioned at two opposite sides of the driven first or second pixel.

In one embodiment of the present invention, each of the scan signals is twice as wide as each of the data signals, and turned-on durations of each adjacent two of the scan lines are partially overlapped.

Another object of the present invention is to provide an OLED panel, and the OLED panel comprises: a substrate; a plurality of pixel rows arranged on the substrate, wherein each of the pixel rows includes pairs of first and second pixels adjacent to each other; a plurality of data lines arranged parallel to the pixel rows and positioned between the first and second pixels, respectively; a plurality of scan lines crossing the data lines; and a plurality of power lines arranged parallel to the pixel rows and positioned two opposite sides of each of the pixel rows, respectively; wherein, when driving one of the first pixels and the second pixels, two of the scan lines are turned on at the same time, and the turned-on scan lines are positioned at two opposite sides of the driven first or second pixel, and data signals are provided to the data lines by data drivers, and scan signals are provided to the scan lines by scan drivers, and each of the scan signals is twice as wide as each of the data signals, and turned-on durations of each adjacent two of the scan lines are partially overlapped.

In the OLED panel of the present invention and the method for driving the same, the number of the data lines decreases, thus increasing the aperture ratio of each of the pixels, as well as improving the service life thereof. In addition, the OLED panel of the present invention can be suitable for a display or electronic apparatus of high pixels per inch (FPI). Furthermore, due to the decrease in the data lines, chips of the data drivers can decrease, thereby greatly reducing a cost of the data drivers.

The structure and the technical means adopted by the present invention to achieve the above-mentioned and other objects can be best understood by referring to the following detailed description of the preferred embodiments and the accompanying drawings:

DETAILED DESCRIPTION OF THE PREFERRED EMBODIMENTS

Figure 1:
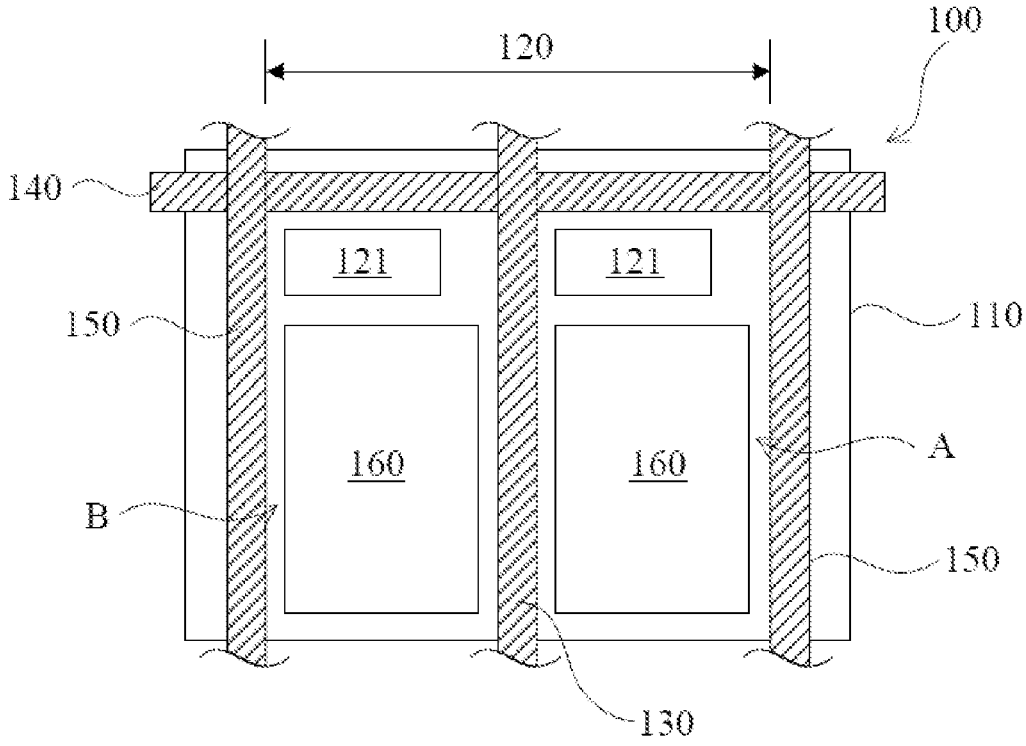
FIG. 1 is a partially cross-sectional view showing an OLED panel according to one embodiment of the present invention.

The following embodiments are referring to the accompanying drawings for exemplifying specific implementable embodiments of the present invention. Furthermore, directional terms described by the present invention, such as upper, lower, front, back, left, right, inner, outer, side and etc., are only directions by referring to the accompanying drawings, and thus the used directional terms are used to describe and understand the present invention, but the present invention is not limited thereto.

The drawings and description are to be regarded as illustrative in nature and not restrictive. Like reference numerals designate like elements throughout the specification. In addition, the size and thickness of each component shown in the drawings are arbitrarily shown for understanding and ease of description, but the present invention is not limited thereto.

In the drawings, the thickness of layers, films, panels, regions, etc., are exaggerated for clarity. In the drawings, for understanding and ease of description, the thicknesses of some layers and areas are exaggerated. It will be understood that, when an element such as a layer, film, region, or substrate is referred to as being "on" another element, it can be directly on the other element or intervening elements may also be present.

In addition, in the specification, unless explicitly described to the contrary, the word "comprise" and variations such as "comprises" or "comprising" will be understood to imply the inclusion of stated elements but not the exclusion of any other elements. Furthermore, in the specification, "on" implies being positioned above or below a target element and does not imply being necessarily positioned on the top on the basis of a gravity direction.

Referring to FIG. 1, a partially cross-sectional view showing an OLED panel according to one embodiment of the present invention is illustrated. The OLED panel 100 of the present invention can comprise a substrate 110, a plurality of pixel rows 120, a plurality of data lines 130, a plurality of scan lines 140, a plurality of power lines 150 and a plurality of OLED units 160. The pixel rows 120 are arranged along a direction on the substrate 110, wherein each of the pixel rows includes pairs of first and second pixels A and B adjacent to each other. The data lines 130 are disposed on substrate 110 and arranged parallel to the pixel rows 120, and the data lines 130 are positioned between the first and second pixels A and B, respectively. The scan lines 140 are disposed on substrate 110 and cross the data lines. The power lines 150 are disposed on substrate 110 and arranged parallel to the pixel rows 120, and the power lines 150 are positioned two opposite sides of each of the pixel rows 120, respectively. Herein, a boundary of one pixel A or B may be defined by the data line 130, the scan line 140 and the power line. The OLED units 160 are disposed in the pixels A and B of the pixel rows 120 for emitting light, and each of the pixels A and B includes a pixel circuit region 121 for arranging pixel circuit elements of the pixels A and B.

Figure 2:
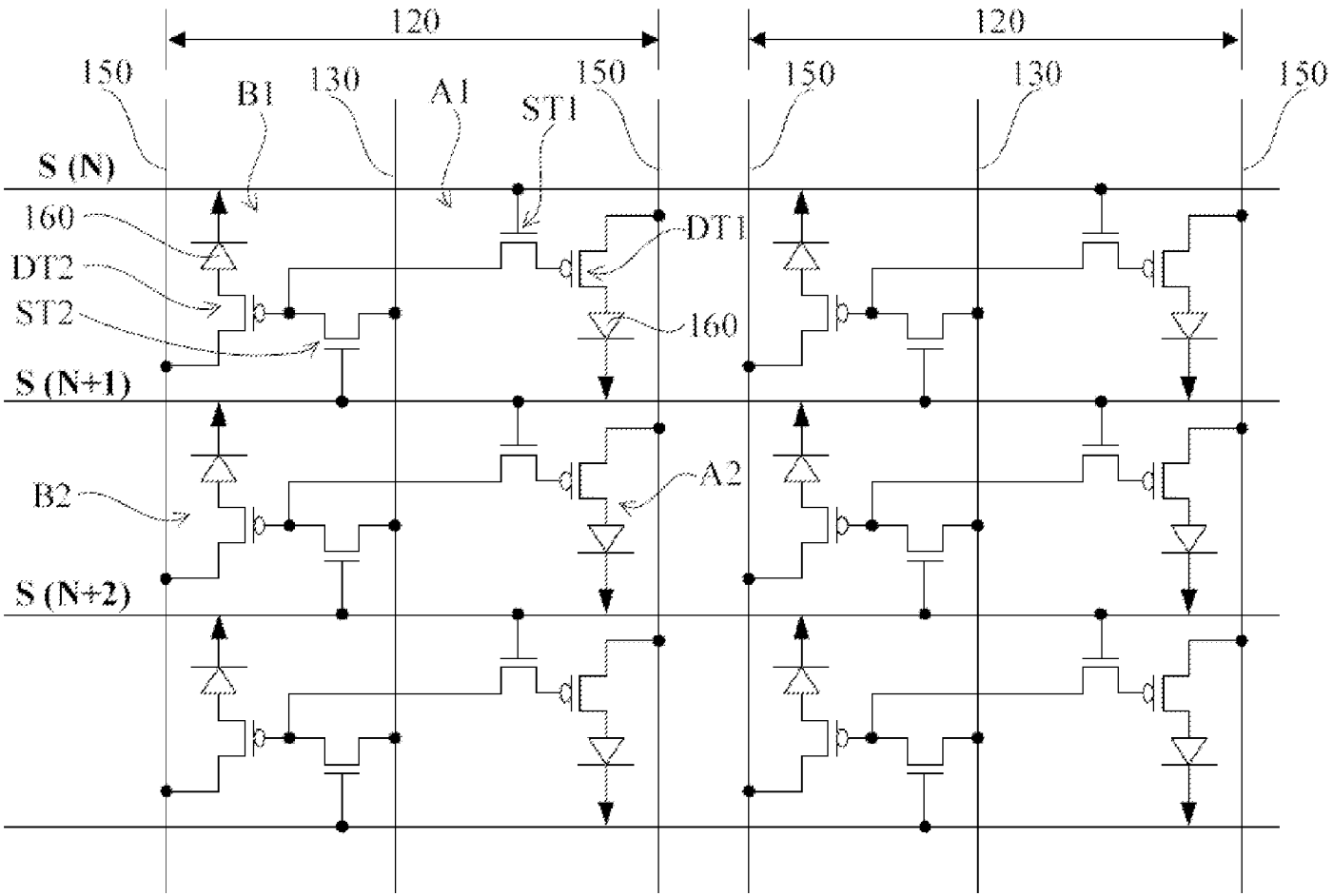
FIG. 2 is an equivalent circuit diagram of the OLED panel according to one embodiment of the present invention.

Referring to FIG. 1 and FIG. 2, FIG. 2 is an equivalent circuit diagram of the OLED panel according to one embodiment of the present invention. In each of the pixel rows 120, each of the first pixels A includes a first switching transistor ST1 and a first driving transistor DT1, and the first switching transistor ST1 and the first driving transistor DT1 are disposed in the pixel circuit region 121 of the first pixel A. Each of the second pixels B includes a second switching transistor ST2 and a second driving transistor DT2, and the second switching transistor ST2 and the second driving transistor DT2 are disposed in the pixel circuit region 121 of the second pixel B. In this embodiment, the switching transistors ST1 and ST2 and the driving transistors DT1 and DT2 may be thin film transistors. In the first pixel A, the first switching transistor ST1 is connected to the scan line 140, the first driving transistor DT1 and the second switching transistor ST2 of the second pixel B, and the first driving transistor DT1 is connected to the first switching transistor ST1, the power line 150 and the OLED unit 160. In the second pixel B, the second switching transistor ST2 is connected to the scan line 140, the data line 130 and the second driving transistor DT2, and the second driving transistor DT2 is connected to the second switching transistor ST2, the power line 150 and the OLED unit 160.

Referring to FIG. 2 again, in each of the first pixels A, such as in the first pixel A1, a gate electrode of the first switching transistor ST1 is connected to one scan line S(n) of the scan line 140, and a source electrode of the first switching transistor ST1 is connected to the second switching transistor ST2 of the adjacent second pixel B1, and a drain electrode of the first switching transistor ST1 is connected to the first driving transistor DT1. Moreover, in the first pixel A1, a gate of the first driving transistor DT1 is connected to the drain electrode of the first switching transistor ST1, and a source electrode of the first driving transistor DT1 is connected to the adjacent power line 150, and a drain electrode of the first driving transistor DT1 is connected to the OLED unit 160. In each of the second pixels B, such as in the second pixel B 1, a gate electrode of the second switching transistor ST2 is connected to the next scan line S(n+1), and a source electrode of the second switching transistor ST2 is connected to the data line 130 between the first pixel A1 and the second pixel B 1, and a drain electrode of the second switching transistor ST2 is connected to the source electrode of the first switching transistor ST1 and the second driving transistor DT2. Moreover, in the second pixel B 1, a gate of the second driving transistor DT2 is connected to the drain electrode of the second switching transistor ST2, and a source electrode of the second driving transistor DT2 is connected to another adjacent power line 150, and a drain electrode of the second driving transistor DT2 is connected to the OLED unit 160.

The OLED unit 160 in each of the pixels A or B includes an anode (not shown) acting as a hole injection electrode, an organic emission layer (not shown) and a cathode (not shown) acting as an electron injection electrode. When an exciton generated by a combination of the holes and the electrons injected into the organic emission layer of the OLED unit 160 falls from an excited state to a ground state, the organic emission layer of the OLED unit 160 emits light.

Figure 3:
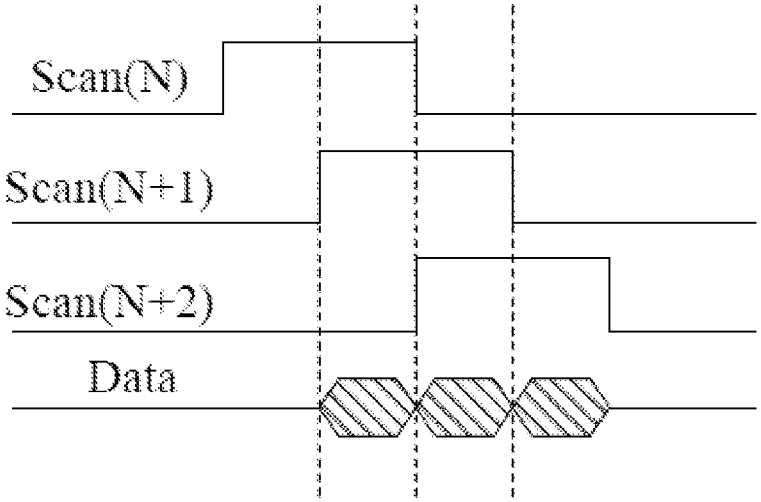
FIG. 3 is an oscillogram of signals of the OLED panel according to one embodiment of the present invention.

Referring to FIG. 3, an oscillogram of signals of the OLED panel according to one embodiment of the present invention is illustrated. The method for driving the OLED panel of this embodiment comprises the following steps: providing the data signals Data to the first pixels A and/or the second pixels B through the data lines; providing a voltage to the first pixels A and/or the second pixels B through the power lines 150; and providing the scan signals Scan to the first pixels A and the second pixels B in sequence through the scan lines 140, wherein, when driving one of the first pixels A and the second pixels B, two of the scan lines are turned on at the same time, and the two turned-on scan lines are positioned at two opposite sides of the driven pixel A or B. In this embodiment, the data signals Data can be provided to the data lines 130 by data drivers (not shown), and the scan signals Scan can be provided to the scan lines 140 by scan drivers (not shown), and the voltage can be provided to the power lines 150 by a power supply module (not shown).

Referring to FIG. 2 and FIG. 3 again, for example, when driving the first pixel A1 of the OLED panel 100 to emit light, the scan lines S(n) and S(n+1) which are positioned at both sides of the first pixel A1 are turned on at the same time, and the voltage is provided to the first pixel A1 by the power line 150 which is positioned at a right side thereof. Therefore, the first switching transistor ST1 in the first pixel A1 and the second switching transistor ST2 in the second pixel B 1 can be turned on, so that the data signals Data of the data lines 130 can be provided to the first driving transistor DT1 of the first pixel A1 through the transistors ST2, ST1 in sequence, so as to turn on the first driving transistor DT1. Accordingly, a current generated by the voltage of the power lines 150 can be provided to the OLED unit 160 in the first pixel A1, thereby driving the OLED unit 160 to emit light.

Referring to FIG. 2 and FIG. 3 again, when driving the second pixel B 1 of the OLED panel 100 to emit light, the scan lines S(n) and S(n+1) which are positioned at both sides of the second pixel B 1 are turned on at the same time, and the voltage is provided to the second pixel B 1 by the power line 150 which is positioned at a left side thereof. Therefore, the second switching transistor ST2 in the second pixel B1, so that the data signals Data of the data lines 130 can be provided to the second driving transistor DT2 of the second pixel B1 through the transistor ST2, so as to turn on the second driving transistor DT2. Accordingly, the current generated by the voltage of the power lines 150 can be provided to the OLED unit 160 in the second pixel B 1, thereby driving the OLED unit 160 to emit light.

Referring to FIG. 2 and FIG. 3 again, similarly, when driving the first pixel A2 to emit light, the scan lines S(n+1) and S(n+2) which are positioned at both sides of the first pixel A2 are turned on at the same time, and the voltage is provided to the first pixel A2 by the power line 150 which is positioned at the right side thereof. Therefore, the data signals Data of the data lines 130 can be provided to the first driving transistor DT1 of the first pixel A2 through the transistors ST2, ST1 in sequence, so as to turn on the first driving transistor DT1, thereby driving the OLED unit 160 in the first pixel A2 to emit light. Similarly, when driving the second pixel B2 to emit light, the scan lines S(n+1) and S(n+2) which are positioned at both sides of the second pixel B2 are turned on at the same time, and the voltage is provided to the second pixel B2 by the power line 150 which is positioned at the left side thereof. Therefore, the data signals Data of the data lines 130 can be provided to the second driving transistor DT2 of the second pixel B2 through the transistor ST2, so as to turn on the second driving transistor DT2, thereby driving the OLED unit 160 in the second pixel B2 to emit light.

Referring to FIG. 3 again, in this embodiment, each of the scan signals Scan is twice as wide as each of the data signals Data, and turned-on durations of each adjacent two of the scan lines 140 are partially overlapped. Therefore, when the data signals Data are inputted to the corresponding pixels A and/or B, the two scan lines 140 which are positioned at two opposite sides of the driven pixel A or B can be turned on at the same time.

As described above, in the OLED panel of the present invention and the method for driving the same, an area occupied by the data lines can be reduced, thereby increasing the aperture ratio of each of the pixels. Therefore, a light emitting area of the OLED units can be enlarged to improve the service life thereof. In addition, the OLED panel of the present invention can have a higher aperture ratio, and thus is suitable for a display or electronic apparatus of high pixels per inch (FPI). Furthermore, due to the decrease in the data lines, chips of the data drivers can decrease, thereby greatly reducing a cost of the data drivers.

The present invention has been described with a preferred embodiment thereof and it is understood that many changes and modifications to the described embodiment can be carried out without departing from the scope and the spirit of the invention that is intended to be limited only by the appended claims.

The invention claimed is:

1. An organic light-emitting display (OLED) panel, comprising:

a substrate;

a plurality of pixel rows arranged on the substrate, wherein each of the pixel rows includes pairs of first and second pixels adjacent to each other;

a plurality of data lines arranged parallel to the pixel rows and positioned between the first and second pixels, respectively;

a plurality of scan lines crossing the data lines; and a plurality of power lines arranged parallel to the pixel rows and positioned two opposite sides of each of the pixel rows, respectively, and a number of power lines is double a number of the pixel rows;

wherein, when driving one of the first pixels and the second pixels, two of the scan lines are turned on at the same time, and the turned-on scan lines are positioned at two opposite sides of the driven first or second pixel, and data signals are provided to the data lines by data drivers, and scan signals are provided to the scan lines by scan drivers, and each of the scan signals is twice as wide as each of the data signals, and turned-on durations of each adjacent two of the scan lines are partially overlapped;

wherein each of the first pixels includes a first switching transistor and a first driving transistor, and each of the second pixels includes a second switching transistor and a second driving transistor;

wherein, in one of the first pixels, a gate electrode of the first switching transistor is connected to one of the scan lines, and a source electrode of the first switching transistor is directly connected to a drain electrode of the second switching transistor of one adjacent second pixel, and a drain electrode of the first switching transistor is connected to the first driving transistor, and a gate of the first driving transistor is connected to the drain electrode of the first switching transistor, and a source electrode of the first driving transistor is connected to one adjacent power line, and a drain electrode of the first driving transistor is connected to the OLED unit of the first pixel;

wherein, in one of the second pixels, a gate electrode of the second switching transistor is connected to one of the scan lines, and a source electrode of the second switching transistor is connected to the data line, and the drain electrode of the second switching transistor is connected to the second driving transistor, and a gate of the second driving transistor is connected to the drain electrode of the second switching transistor, and a source electrode of the second driving transistor is connected to one adjacent power line, and a drain electrode of the second driving transistor is connected to the OLED unit in the second pixel.

2. An OLED panel, comprising:

a substrate;

a plurality of pixel rows arranged on the substrate, wherein each of the pixel rows includes pairs of first and second pixels adjacent to each other;

a plurality of data lines arranged parallel to the pixel rows and positioned between the first and second pixels, respectively;

a plurality of scan lines crossing the data lines; and a plurality of power lines arranged parallel to the pixel rows and positioned two opposite sides of each of the pixel rows, respectively, and a number of the power lines is double a number of the pixel rows;

wherein, when driving one of the first pixels and the second pixels, two of the scan lines are turned on at the same time, and the turned-on scan lines are positioned at two opposite sides of the driven first or second pixel;

wherein each of the first pixels includes a first switching transistor and a first driving transistor, and each of the second pixels includes a second switching transistor and a second driving transistor;

wherein, in one of the first pixels, a gate electrode of the first switching transistor is connected to one of the scan lines, and a source electrode of the first switching transistor is directly connected to a drain electrode of the second switching transistor of one adjacent second pixel, and a drain electrode of the first switching transistor is connected to the first driving transistor, and a gate of the first driving transistor is connected to the drain electrode of the first switching transistor, and a source electrode of the first driving transistor is connected to one adjacent power line, and a drain electrode of the first driving transistor is connected to the OLED unit of the first pixel;

wherein, in one of the second pixels, a gate electrode of the second switching transistor is connected to one of the scan lines, and a source electrode of the second switching transistor is connected to the data line, and the drain electrode of the second switching transistor is connected to the second driving transistor, and a gate of the second driving transistor is connected to the drain electrode of the second switching transistor, and a source electrode of the second driving transistor is connected to one adjacent power line, and a drain electrode of the second driving transistor is connected to the OLED unit in the second pixel.

3. The OLED panel according to claim 2, wherein data signals are provided to the first pixels and/or the second pixels through the data lines, and scan signals are provided to the first pixels and/or the second pixels through the scan lines, and each of the scan signals is twice as wide as each of the data signals, and turned-on durations of each adjacent two of the scan lines are partially overlapped.

4. A method for driving an OLED panel, wherein the OLED panel comprises a plurality of pixel rows, a plurality of data lines, a plurality of scan lines and a plurality of power lines, and each of the pixel rows includes pairs of first and second pixels adjacent to each other, and the data lines are arranged parallel to the pixel rows and positioned between the first and second pixels, respectively, and the scan lines cross the data lines, and the power lines are arranged parallel to the pixel rows and positioned two opposite sides of each of the pixel rows, respectively, and a number of the power lines is double a number of the pixel rows, and the method comprises the following steps:

providing data signals to the first pixels and/or the second pixels through the data lines;

providing a voltage to the first pixels and/or the second pixels through the power lines; and providing scan signals to the first pixels and the second pixels in sequence through the scan lines, wherein, when driving one of the first pixels and the second pixels, two of the scan lines are turned on at the same time, and the two turned-on scan lines are positioned at two opposite sides of the driven first or second pixel;

wherein each of the first pixels includes a first switching transistor and a first driving transistor, and each of the second pixels includes a second switching transistor and a second driving transistor;

wherein, in one of the first pixels, a gate electrode of the first switching transistor is connected to one of the scan lines, and a source electrode of the first switching transistor is directly connected to a drain electrode of the second switching transistor of one adjacent second pixel, and a drain electrode of the first switching transistor is connected to the first driving transistor, and a gate of the first driving transistor is connected to the drain electrode of the first switching transistor, and a source electrode of the first driving transistor is connected to one adjacent power line, and a drain electrode of the first driving transistor is connected to the OLED unit of the first pixel;

wherein, in one of the second pixels, a gate electrode of the second switching transistor is connected to one of the scan lines, and a source electrode of the second switching transistor is connected to the data line, and the drain electrode of the second switching transistor is connected to the second driving transistor, and a gate of the second driving transistor is connected to the drain electrode of the second switching transistor, and a source electrode of the second driving transistor is connected to one adjacent power line, and a drain electrode of the second driving transistor is connected to the OLED unit in the second pixel.

5. The method according to claim 4, wherein each of the scan signals is twice as wide as each of the data signals, and turned-on durations of each adjacent two of the scan lines are partially overlapped.

* * * * *